US008316674B2

(12) United States Patent
Kowalczyk

(10) Patent No.: US 8,316,674 B2
(45) Date of Patent: Nov. 27, 2012

(54) LOCK

(76) Inventor: Piotr Leonard Kowalczyk, Roodekrans (ZA)

( * ) Notice: Subject to any disclaimer, the term of this patent is extended or adjusted under 35 U.S.C. 154(b) by 0 days.

(21) Appl. No.: 12/921,678

(22) PCT Filed: Mar. 10, 2009

(86) PCT No.: PCT/IB2009/051000

§ 371 (c)(1),
(2), (4) Date: Sep. 9, 2010

(87) PCT Pub. No.: WO2009/113022

PCT Pub. Date: Sep. 17, 2009

(65) Prior Publication Data

US 2011/0016934 A1 Jan. 27, 2011

(30) Foreign Application Priority Data

Mar. 11, 2008 (ZA) ..... 2008/02312

(51) Int. Cl.
*E05B 47/00* (2006.01)

(52) U.S. Cl. ..... 70/277; 70/278.2; 70/278.3; 70/278.7; 70/283; 70/283.1

(58) Field of Classification Search ..... 70/277, 70/278.2, 278.3, 278.7, 279.1, 283, 283.1
See application file for complete search history.

(56) References Cited

U.S. PATENT DOCUMENTS

| | | | | |
|---|---|---|---|---|
| 4,573,333 | A * | 3/1986 | Choi | 70/279.1 |
| 5,791,177 | A * | 8/1998 | Bianco | 70/283.1 |
| 5,878,612 | A | 3/1999 | Mauer | |
| 6,293,131 | B1 * | 9/2001 | Lemettinen et al. | 70/278.7 |
| 6,622,535 | B2 * | 9/2003 | Chiang et al. | 70/107 |
| 6,655,179 | B2 * | 12/2003 | Kobayashi et al. | 70/237 |
| 6,892,557 | B2 * | 5/2005 | Bieniek | 70/278.7 |
| 7,431,354 | B2 * | 10/2008 | Raatikainen | 292/137 |
| 7,966,854 | B2 * | 6/2011 | Imedio Ocana | 70/472 |
| 2007/0137326 | A1 | 6/2007 | Meyerle | |
| 2008/0078220 | A1 * | 4/2008 | Kim | 70/283.1 |

FOREIGN PATENT DOCUMENTS

| | | | |
|---|---|---|---|
| DE | 1109053 | | 6/1961 |
| DE | 102004013196 | | 7/2005 |
| EP | 0819813 | | 1/1998 |
| EP | 1174570 | | 1/2002 |
| GB | 2309732 | | 8/1997 |
| WO | WO 02/16714 | * | 2/2002 |

OTHER PUBLICATIONS

Patent Cooperation Treaty, International Search Report and Written Opinion of the International Search Authority, PCT/IB2009/051000, Jul. 14, 2009, 11 pages.

* cited by examiner

*Primary Examiner* — Lloyd Gall
*Assistant Examiner* — David E Sosnowski
(74) *Attorney, Agent, or Firm* — Viksnins Harris & Padys PLLP

(57) ABSTRACT

A lock (10) which includes a body and an actuator (36) which is pivotally displaceable between a rest position and a displaced position. The lock further includes a first member (64) which is longitudinally displaceable by the actuator (36) and a second 5 member (66) which is longitudinally in register with the first member (64) and longitudinally displaceable relative to the body and the first member (64). The lock includes bias means (90) biasing the first and second members (64, 66) away from one another. The lock further includes retaining means (98) which is displaceable from a locked position, in which it inhibits displacement of the second member (66) and a 10 released position in which it permits displacement of the second member (66).

19 Claims, 7 Drawing Sheets

LOCK

RELATED APPLICATIONS

This application claims priority to South African Patent Application Number 2008/02312 that was filed on Mar. 11, 2008.

This invention relates to a lock.

According to one aspect of the invention there is provided a lock which includes:

a body;

an actuator mounted on the body for pivotal displacement about a pivot axis between a rest position, towards which it is biased and a displaced position;

a first member which cooperates with the actuator and is longitudinally displaceable relative to the body along a longitudinal axis from a rest position, towards which it is biased, to a displaced position, in response to displacement of the actuator from its rest position towards its displaced position;

a second member which is longitudinally in register with the first member, the second member being longitudinally displaceable relative to the body between a rest position and a displaced position and the first and second members being longitudinally displaceable relative to each other;

bias means biasing the first and second members longitudinally away from one another; and retaining means which is displaceable from a locked position, in which it inhibits longitudinal displacement of the second member away from its rest position, to a released position, in which it permits longitudinal displacement of the second member away from its rest position.

Hence, in use, when the retaining means is in its locked position, actuation of the actuator will serve to displace the first member longitudinally away from its rest position towards its displaced position, however, the second member is prevented from being displaced away from its rest position. When the retaining means is in its released position, then when the actuator is displaced towards its displaced position thereby displacing the first member away from its rest position towards its displaced position, the second member is simultaneously displaced from its rest position to its displaced position.

The longitudinal axis will typically be angularly spaced from the pivotal axis. Preferably, the longitudinal axis will be generally perpendicular to the longitudinal axis.

The actuator may define a cam surface which cooperates with the first member.

The lock may include key identification means and the retaining means may be displaceable from its locked position to its released position in response to a signal received from the key identification means.

It will be appreciated, that the second member can be used as a lock bolt or as part of a displacement arrangement in a lock mechanism or as a latch for locking a lock bolt releasably in a locked or unlocked condition.

According to another aspect of the invention there is provided a lock which includes:

a body:

a bolt which is displaceable relative to the body between a rest position and a displaced position;

a latch which is displaceable between a locked position, towards which it is biased, and in which it inhibits displacement of the bolt from its rest to its displaced position, and an unlocked position in which it permits displacement of the bolt between its rest and its displaced positions;

key identification means; and a latch displacement arrangement which includes an actuator mounted on the body for displacement relative thereto and a transmission device having an inoperative condition in which it prevents displacement of the latch by the actuator and an operative condition in which it permits displacement of the latch by the actuator, the transmission device being linked to the key identification means and being displaced from its inoperative or rest condition into its operative or activated condition, in response to a signal received from the key identification means.

Preferably, the transmission device is positioned between the actuator and the latch. Accordingly, in its operative condition, the transmission device may form an intermediate member which is displaceable by the actuator and which in turn displaces the latch to its unlocked position thereby permitting displacement of the bolt.

The key identification means may be a non-mechanical key identification means. The key identification means may accordingly include electronic control circuitry and communication means whereby the control circuitry can communicate with an encoded key to permit identification of the key by the control circuitry.

The communication means may be configured to permit wireless communication between the key and the control circuitry.

The communication means may include at least one electrical contact which is connected to the electronic control circuitry and is mounted on the body for making contact with a complementary electrical contact on an electrically encoded key.

The actuator may include a lever arm which is mounted on the body for pivotal displacement about a pivot axis and which defines a cam which cooperates with the transmission device.

The transmission device may include a first member, with which the cam cooperates, and a second member, the first and second members being longitudinally displaceable relative to the body, the first and second members also being longitudinally displaceable relative to one another between an extended position, towards which they are biased, and a compressed position, and retaining means which is displaceable in response to a signal received from the key identification means from a locked position, in which it inhibits longitudinal displacement of the second member, to a released position, in which it permits longitudinal displacement of the second member.

Hence, it will be appreciated that when the retaining means is in its locked position, operation of the actuator will result in displacement of the first member but not the second member so that the latch remains in its locked position. However, when the retaining means is in its released position, operation of the actuator causes longitudinal displacement of the first member which in turn causes longitudinal displacement of the second member which displaces the latch to its unlocked position.

The first and second members may be biased towards their extended position by means of at least one coil spring mounted in compression between them.

The retaining means may include at least one displaceable locking member which is displaceable between a rest position, in which it engages the second member to inhibit longitudinal displacement thereof, and displacement means for displacing the locking member from its rest position to a displaced position in which it permits displacement of the second member.

The displacement means may include a solenoid.

Preferably, the retaining means includes a pair of locking members, each of which is displaceable from its rest position to its displaced position by means of a solenoid.

The lever arm may include a bolt engaging formation configured to displace the bolt from its rest position to its displaced position.

The bolt engaging formation and the cam may be positioned on opposite sides of the pivot axis and configured such that the bolt engaging formation drivingly engages the bolt only after the cam has displaced the first member a sufficient distance such that when the retaining means is in its released position, the latch is displaced to its displaced position permitting displacement of the bolt.

The invention will now be described, by way of example, with reference to the accompanying diagrammatic drawings.

Figure 1:
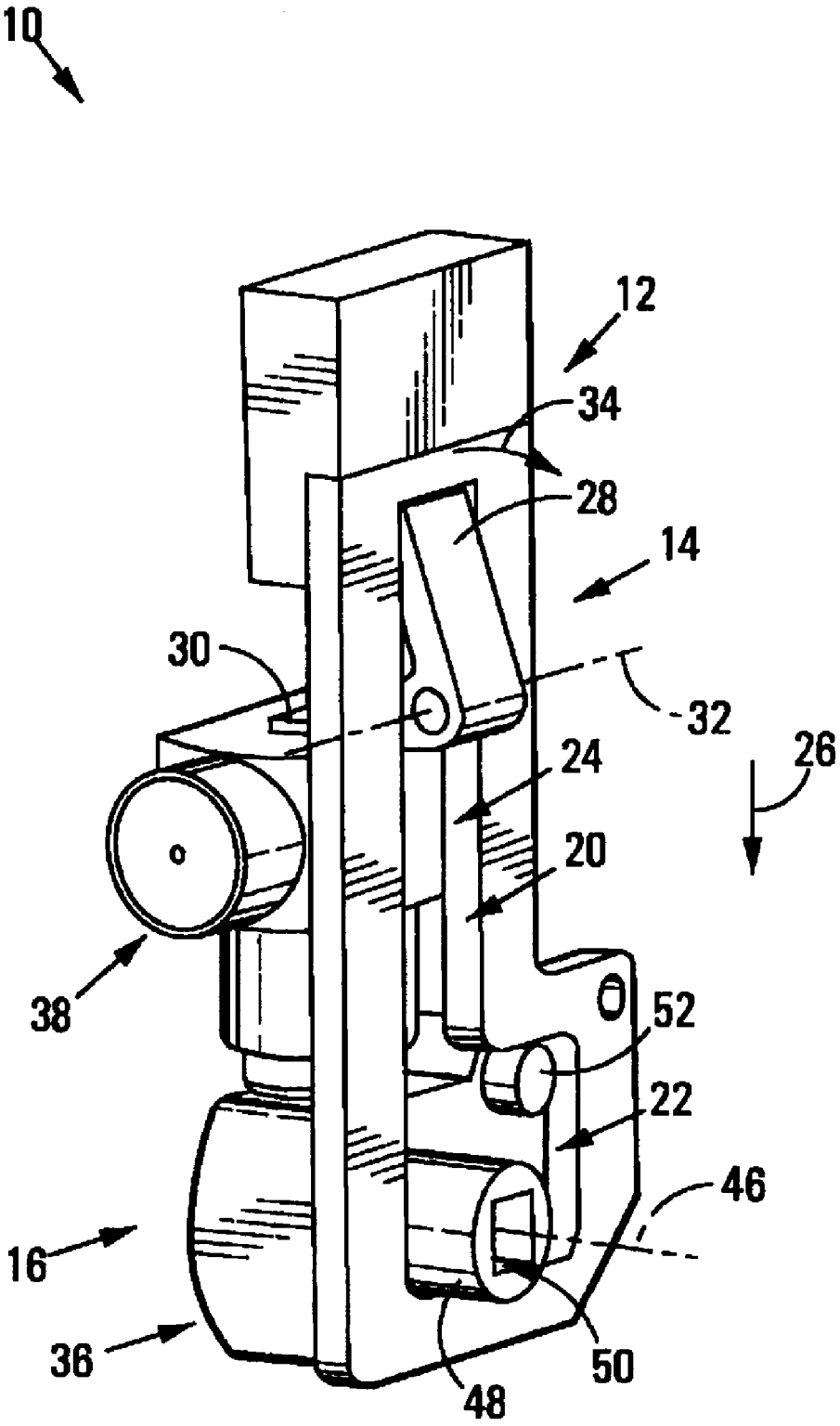
FIG. 1 shows a three-dimensional view of part of a lock in accordance with the invention.

In the drawings, reference numeral 10 refers generally to a lock in accordance with the invention. The lock includes a body or casing 77 (FIG. 7) within which most of the components of the lock 10 are contained. The lock further includes a bolt, generally indicated by reference numeral 12, a latch, generally indicated by reference numeral 14 and a latch displacement arrangement, generally indicated by reference numeral 16.

Figure 6:
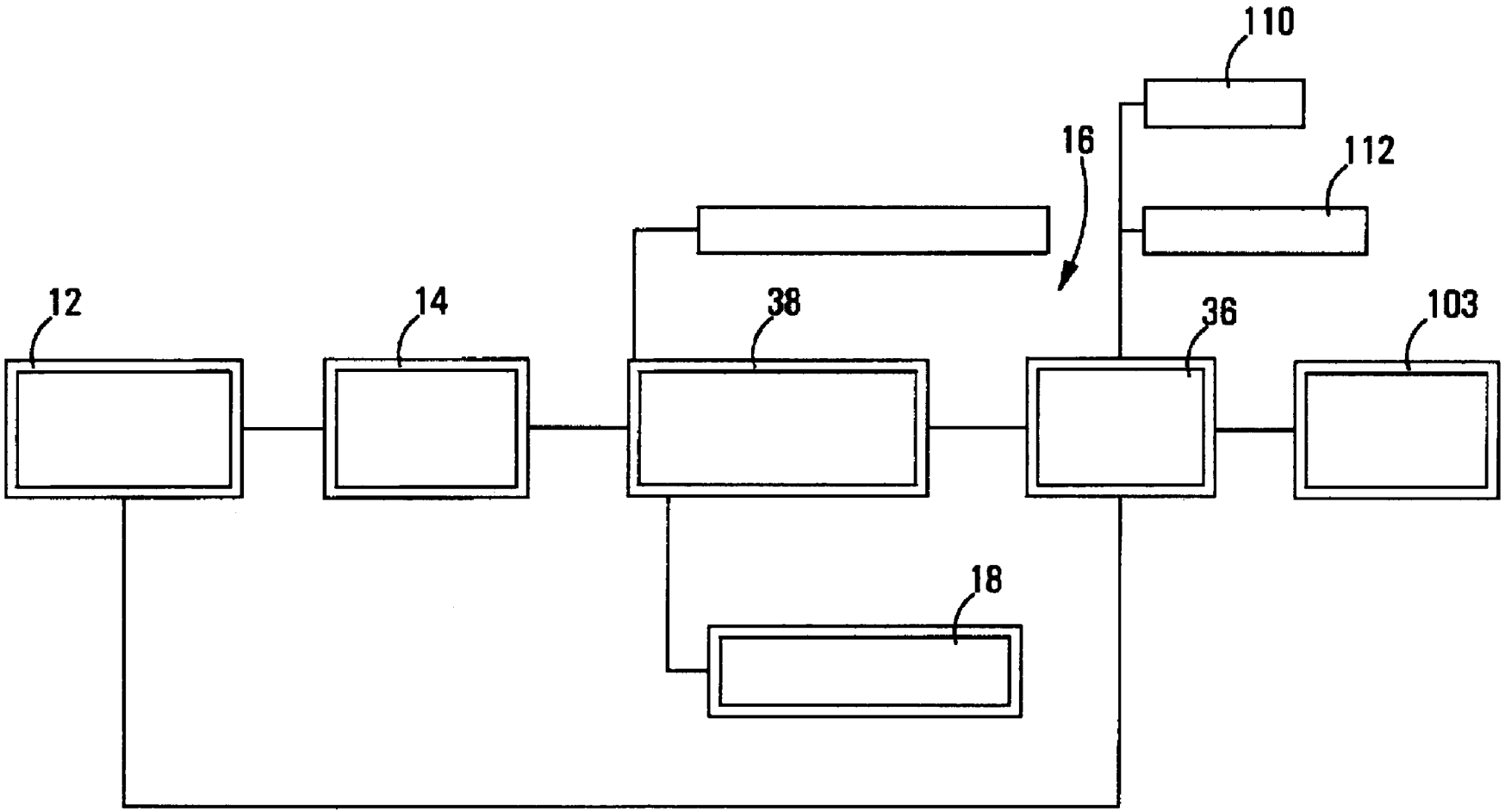
FIG. 6 shows a block diagram of the operation of the lock of FIG. 1.

The lock 10 further includes key identification means 18 (FIG. 6) which is linked to the latch displacement arrangement as described in more detail herebelow.

As can be seen in the drawings, the bolt 12 is generally L-shaped and is provided with a generally L-shaped slot 20 therein. The slot 20 has a lower or horizontal limb 22 and a vertical limb 24. The bolt is displaceable from a rest position (shown in FIG. 1 of the drawings) downwardly in the direction of arrow 26 to a displaced position as described in more detail herebelow.

The latch 14 is generally L-shaped having an upper arm 28 and a lower arm 30. The latch is pivotally connected to the body 77 for pivotal displacement about a pivot axis 32 between a locked position (shown in FIG. 1 of the drawings) and an unlocked position (shown in FIG. 5 of the drawings). The latch 14 is biased towards its locked position by a spring (not shown) mounted between the latch 14 and the body 77. In its locked position, the free end of the upper arm 28 of the latch 14 is in register with the edge of the bolt 12 defining the upper end of the vertical limb 24 thereby to prevent displacement of the bolt 12 from its rest position towards its displaced position. As can best be seen in FIG. 5 of the drawings, when the latch 14 is in its displaced position, it is pivotally displaced in the direction of arrow 34 such that the upper arm 28 is out of register with the bolt 12 permitting displacement of the bolt towards its displaced position.

The latch displacement arrangement 16 includes an actuator, generally indicated by reference numeral 36 and a transmission device, generally indicated by reference numeral 38.

The actuator 36 includes a lever arm, generally indicated by reference numeral 40. The lever arm 40 includes a generally sector-shaped body 42 which defines a cam surface 44. The lever arm 40 is pivotally connected to the body 77 of the lock 10 for pivotal displacement about a pivot axis 46. A circular cylindrical boss 48 protrudes from the body 42 coaxially with the pivot axis 46 and defines a non-circular, typically square, hole 50 with which a complementary driving formation, e.g. a rod is drivingly engageable to permit angular displacement of the lever arm 40 about the pivot axis 46. The driving formation will typically be connected to a handle or form part of a key. The boss 48 protrudes through the slot 20. The actuator 36 further includes a bolt engaging formation in the form of a circular cylindrical protrusion 52 which protrudes from the body 42 in the same direction as the boss 48 such that it protrudes into the slot 20 and more particularly the horizontal limb 22 of the slot 20. The protrusion 52 and cam surface 44 are positioned generally on opposite sides of the pivot axis 46 such that when the lever arm 40 is displaced in a direction which causes the cam surface 44 to move upwardly, the protrusion 52 moves downwardly.

Figure 2:
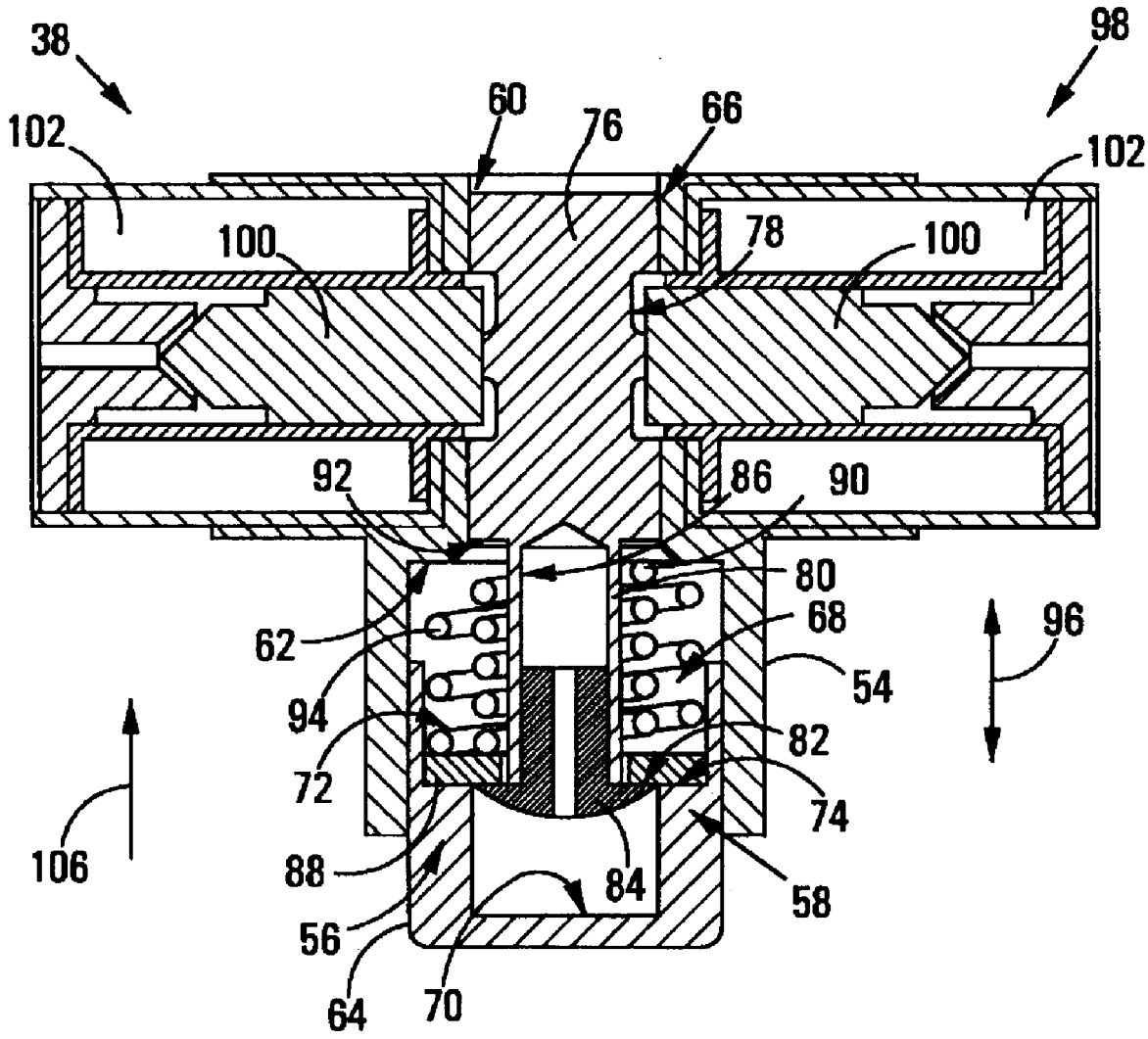
FIG. 2 shows a transverse sectional view of a transmission device forming part of the lock of FIG. 1 in its inoperative condition.
Figure 3:
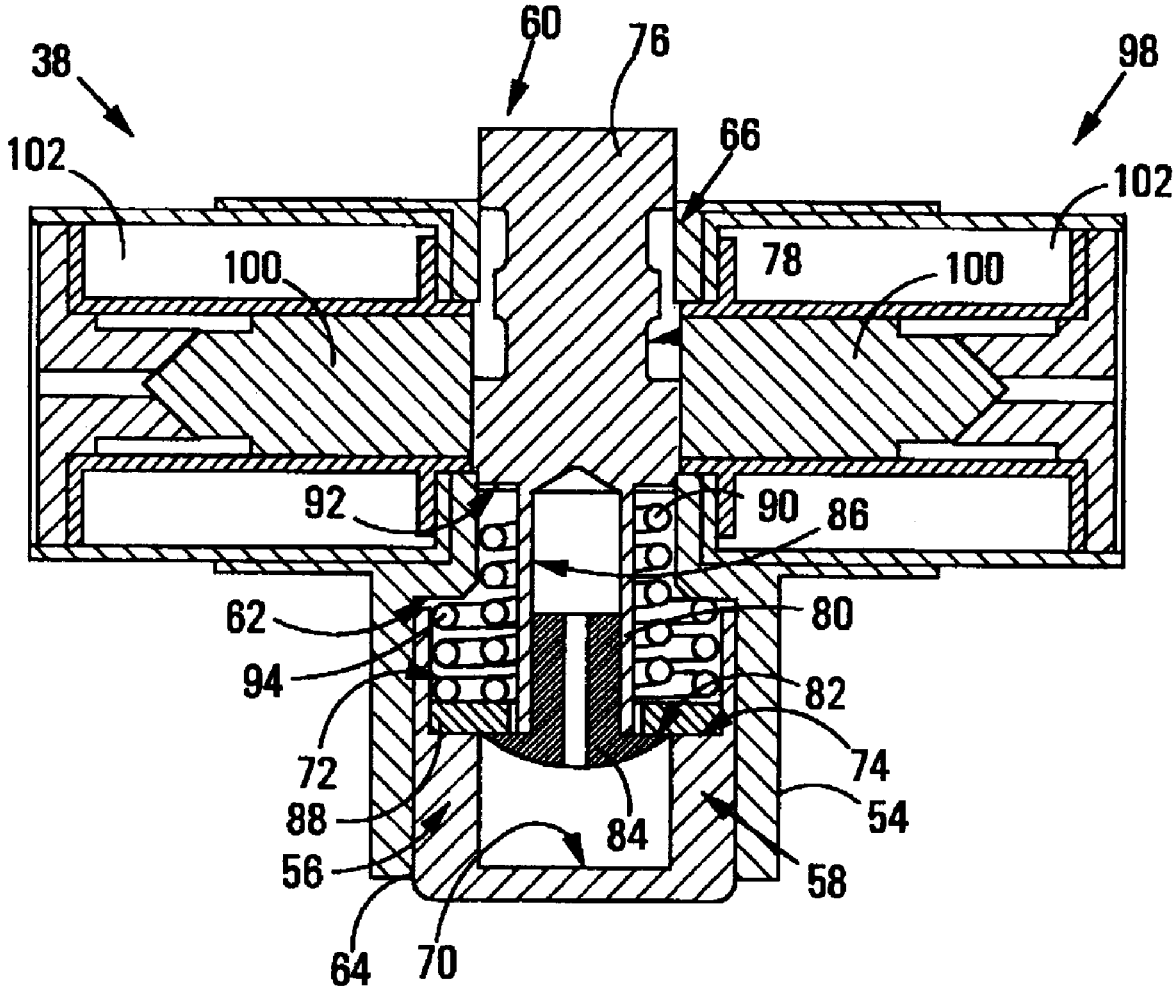
FIG. 3 shows a transverse sectional view, similar to FIG. 2, of the transmission device in its operative condition.
Figure 7:
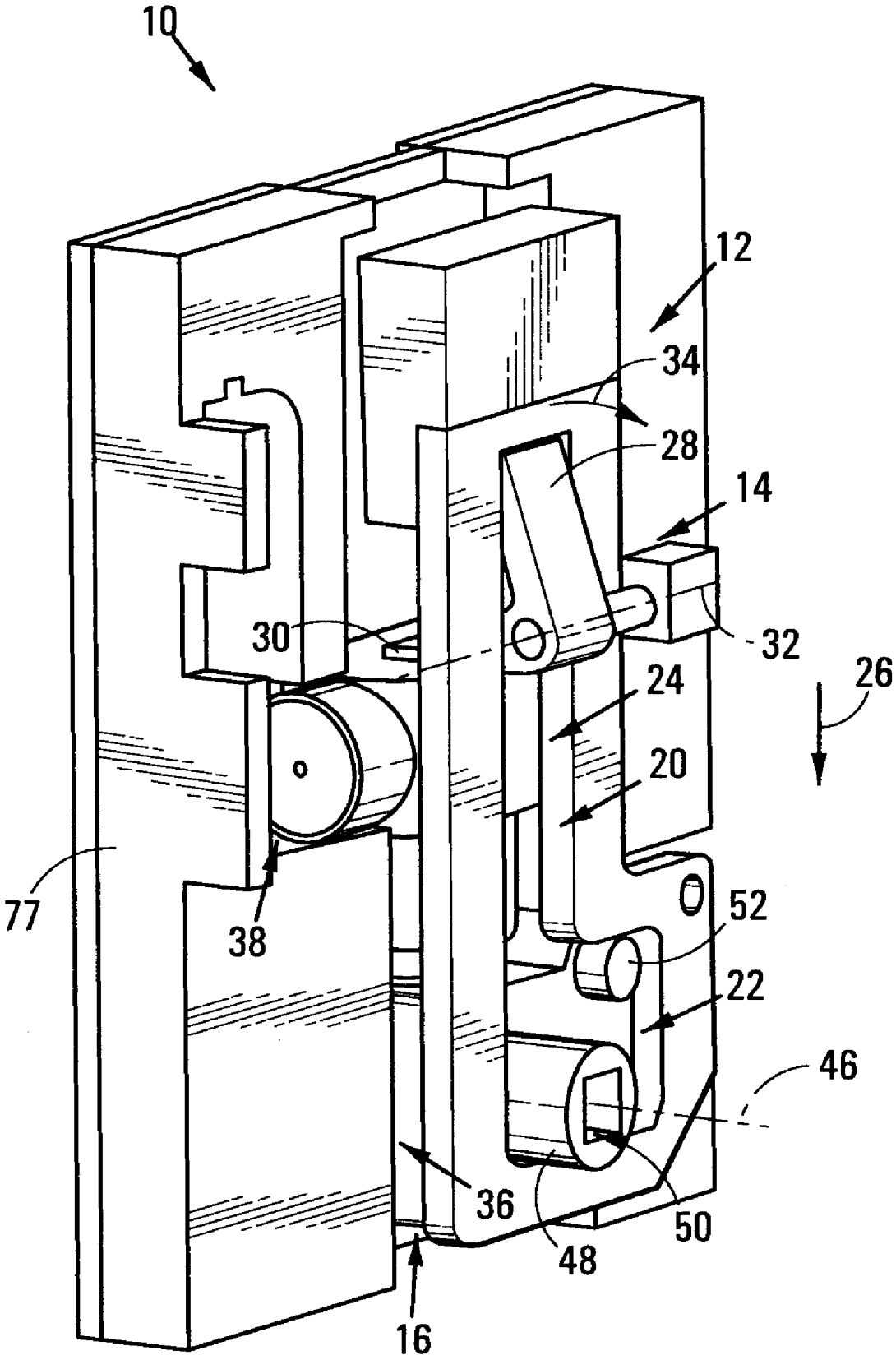
FIG. 7 shows a three-dimensional view of a lock.

As can best be seen in FIGS. 2, 3 and 7 of the drawings, the transmission device 38 includes a housing 54 which is mounted rigidly on the body 77 of the lock 10. The housing 54 defines a passage way 56 therethough. The passage way 56 consists of first and second portions 58, 60 which are coaxial, the first portion 58 having a diameter which is larger than that of the second portion 60 such that an annular shoulder 62 is defined at the intersection of the first and second portions 58, 60. The transmission device includes first and second members 64, 66 respectively. The first member 64 is circular cylindrical and has a blind bore 68 extending from an operatively inner end of the first member 64. The bore 68 has an inner portion 70 and an outer portion 72 which is of larger diameter than the inner portion 70 such that an annular shoulder 74 is defined at the intersections of the inner and outer portion 70, 72. The second member 66 includes a circular cylindrical body 76 having an annular recess 78 provided therein approximately midway along its length. An elongate circular cylindrical protrusion 80 protrudes from an end of the body 76 coaxially therewith, part of the protrusion 80 being received in the bore 68. An annular shoulder 82 is provided at the free end of the protrusion 80 by means of the head of a screw 84 mounted in a screw threaded hole 86 which extends longitudinally inwardly from the free end of the protrusion 80. An annular washer 88 is mounted over the protrusion 80 and held captive thereon by means of the shoulder 82. An inner coil spring 90 is mounted over the protrusion 80 between the washer 88 and a shoulder 92 formed by the portion of the free end of the body 76 which protrudes radially outwardly beyond the protrusion 80. An outer coil spring 94 is mounted around the inner coil spring 90 between the washer 88 and the shoulder 62.

The first and second members 64, 66 are displaceable in the direction of arrow 96 relative to the housing 54 and relative to each other as discussed in more detail below.

The transmission device 38 further includes retaining means, generally indicated by reference numeral 98. The retaining means 98 includes two locking members 100 each of which is displaceable by a solenoid 102 between an extended position (shown in FIG. 2 of the drawings) in which they engage the annular recess 72 at diametrically opposed positions and inhibit longitudinal displacement of the second member 66 and a retracted position (shown in FIG. 3 of the drawings) in which they permit longitudinal displacement of the second member 66. The solenoids 102 are operated in response to a signal received from the key identification means 108.

Figure 4:
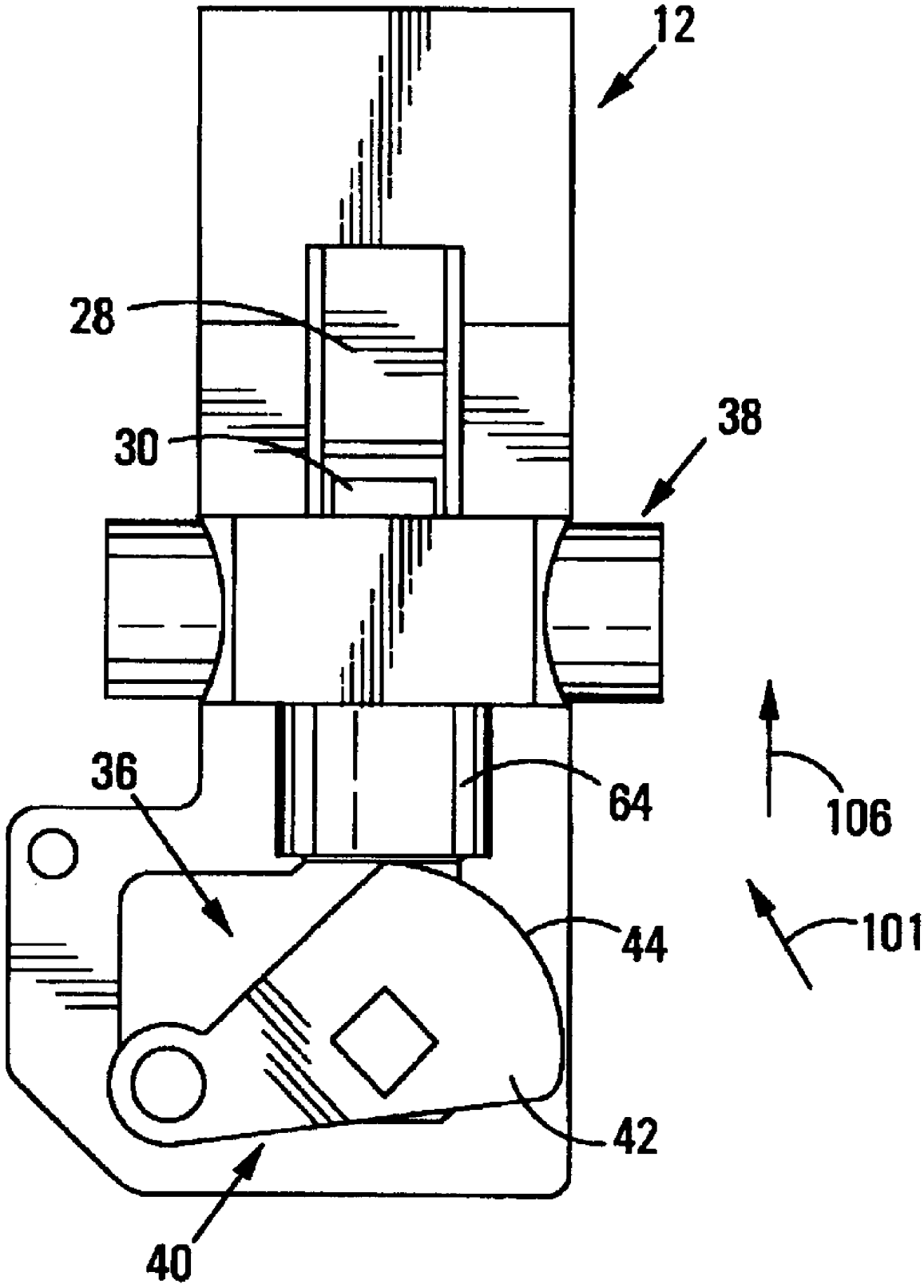
FIG. 4 shows a rear view of the lock of FIG. 1.

In use, with the lock 10 in its locked position, the locking members 100 will be in their extended positions thereby inhibiting displacement of the second member 66. If the actuator 36 is actuated, e.g. if for example by means of a door handle, the lever arm 40 is displaced about the pivot axis in the direction of arrow 101 (FIG. 4). The cam surface 44 abuts against the closed or outer end of the first member 64 displacing it in the direction of arrow 106. However, by virtue of the fact that the locking members 100 are in their extended position, the second member 66 is not displaceable and hence the displacement of the first member 66 simply causes the springs 90. 94 to be compressed. When the protrusion 52 abuts against the edge of the bolt 12 defining the lower edge of the horizontal limb 22, displacement of the bolt 12 downwardly is inhibited by the latch 14.

Figure 5:
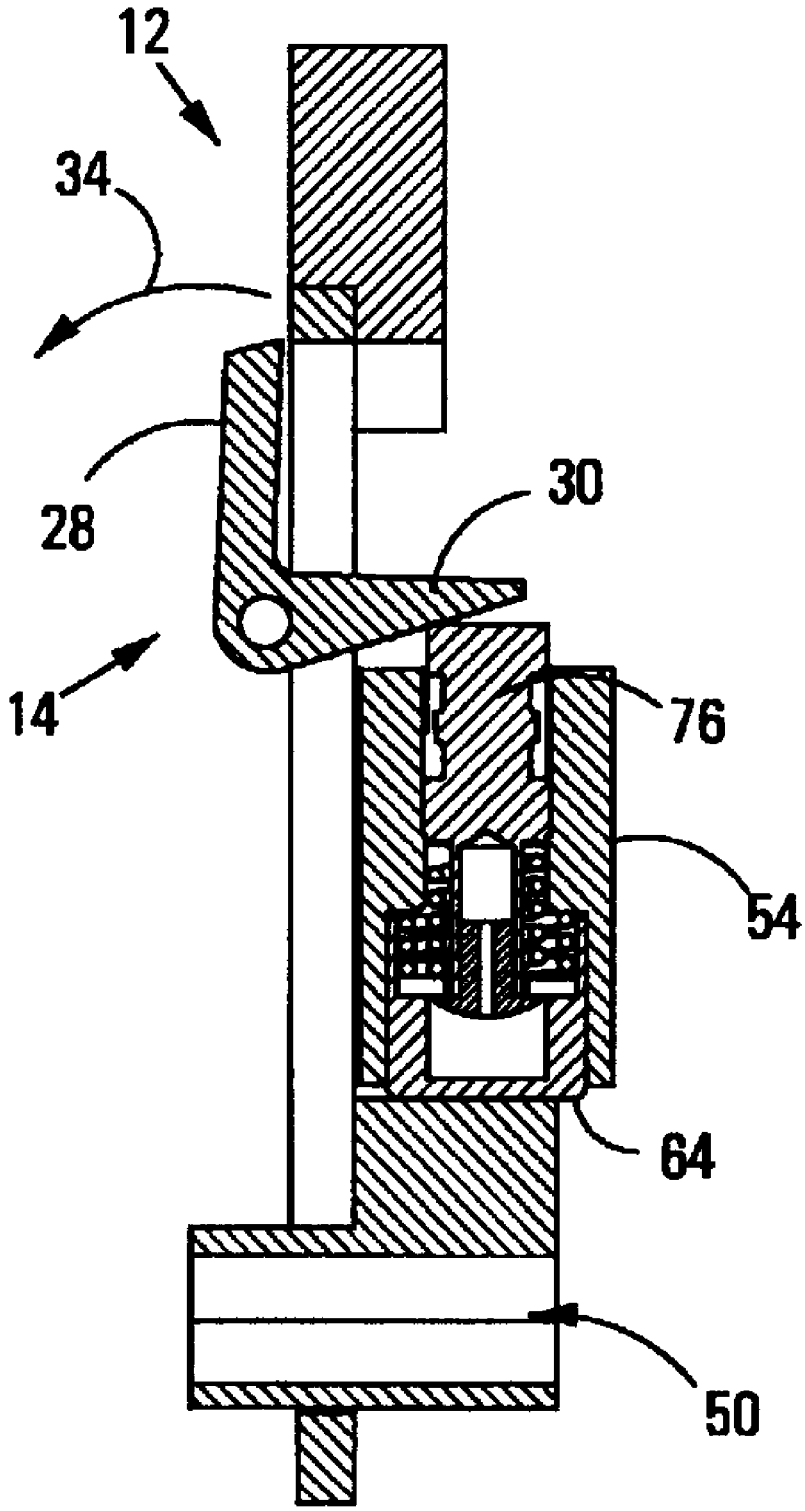
FIG. 5 shows a side view of the lock of FIG. 1.

If, however, prior to displacement of the actuator 66, an authorised key 103 (FIG. 6) is identified, then the solenoids 102 are energised thereby retracting the locking members 100. If the actuator 36 is now displaced in the direction of arrow 101, when the cam surface 44 abuts the first member 64 it is displaced in the direction of arrow 106, however, instead of merely compressing the springs 90, 94, the second member 66 is also displaced in the direction of arrow 106 so that it protrudes from the housing 54 and abuts against the lower arm 30 of the latch 14 thereby displacing the latch, in the direction of arrow 34, from its locked position to its unlocked position (as illustrated by block 110 in FIG. 6 and as shown in FIG. 5 of the drawings). Further displacement of the actuator 36 brings the protrusion 52 into contact with the bolt 12 thereby permitting the bolt to be displaced in the direction of arrow 26 thereby opening the lock (as illustrated by block 112 in FIG. 6). When the actuator 66 is released, the components of the lock return to their rest position shown in FIG. 1 of the drawings.

It will be appreciated that the key could take any suitable form. For example, it could be encoded and could be inserted into a reader. Instead, the key could be recognised remotely, e.g. by means of a radio or infra red transmitter and receiver arrangement. In addition, if desired, the key could be used as a structural component through which drive to the actuator 36 is transmitted. It will also be appreciated that the key may include electrical contacts for supplying power to the solenoid. Alternatively, the communication can be contact less, e.g. by infra red, radio etc. Power can also be delivered to the solenoids in a contact less fashion, e.g. by means of an inductive arrangement or the solenoids may be provided with their own power source.

The springs 90, 94 and solenoids 102 will typically be selected that, if the actuator 36 is displaced prior to the solenoids being energised, the load applied to the second member 66 through the spring 90 will be such that even if the solenoids are then energised, the locking members 100 will not be retracted. This permits the use of relatively small solenoids with low energy requirements.

It will be appreciated that in its simplest form a lock in accordance with the invention could consist of the actuator 36 and the transmission device 38. The second member 66 could then function as a bolt. Various other lock configurations are possible incorporating this mechanism.

In addition, the Inventor believes that the arrangement of the lock is relatively less complex than other prior art locks of which he is aware which has benefits both in respect of cost and reliability. In addition, the Inventor believes that the provision of the transmission device 38 between the actuator and the latch, enhances the security of the lock since the latch will not be displaced irrespective of the load applied to the actuator 36 unless the solenoids of the transmission device have been energised. In addition, by virtue of the fact that the transmission device 38 is out of register with, for example, a handle connected to the actuator, direct access to the transmission device is prevented thereby enhancing the security of the lock. In addition, by virtue of the configuration the forces on the solenoids are small permitting the use of small energy efficient solenoids which serves both to reduce power consumption and the size of the mechanism when compared with prior art locks of which the Inventor is aware.

The Inventor believes that a lock in accordance with the invention can be readily incorporated into existing locks thereby enhancing the security of the existing locks.

The invention claimed is:

1. A lock which includes:

a body;

a first member which is longitudinally displaceable relative to the body along a longitudinal axis from a rest position, towards which it is biased, to a displaced position;

a second member which is longitudinally in register with the first member, the second member being longitudinally displaceable relative to the body between a rest position and a displaced position and the first and second members being longitudinally displaceable relative to each other;

bias means biasing the first and second members longitudinally away from one another;

retaining means which is displaceable from a locked position, in which it inhibits longitudinal displacement of the second member away from its rest position, to a released position, in which it permits longitudinal displacement of the second member away from its rest position; and an actuator mounted on the body for pivotable displacement about a pivot axis between a rest position towards which it is biased by an actuator bias means and a displaced position, the actuator defining a cam surface which when the actuator is pivotally displaced about the pivot axis from its rest position towards its displaced position abuts against an outer end of the first member and displaces the first member longitudinally along the longitudinal axis from its rest position towards the displaced position.

2. A lock as claimed in claim 1, in which the lock further includes key identification means and the retaining means is displaceable from its locked position to its released position in response to a signal received from the key identification means.

3. A lock as claimed in claim 1, in which the second member is used as a lock bolt.

4. A lock as claimed in claim 1, in which the second member is used as part of a displacement arrangement in a lock mechanism.

5. A lock as claimed in claim 1, in which the second member is used as a latch for locking a lock bolt releasably in a locked or unlocked condition.

6. A lock as claimed in claim 1, which includes:

a bolt which is displaceable relative to the body between a rest position and a displaced position; and a latch which is displaceable between a locked position, towards it is biased by a latch bias means and in which it inhibits displacement of the bolt from its rest to its displaced position, and an unlocked position which permits displacement of the bolt between its rest and displaced positions, the latch being displaced from its locked position to its unlocked position by the second member when the second member is displaced from its rest position to its displaced position.

7. A lock which includes:

a body:

a bolt which is displaceable relative to the body between a rest position and a displaced position;

a latch which is displaceable between a locked position, towards which it is biased by a latch bias means, and in which it inhibits displacement of the bolt from its rest to its displaced position, and an unlocked position in which it permits displacement of the bolt between its rest and its displaced positions;

key identification means; and a latch displacement arrangement which includes an actuator mounted on the body for displacement relative thereto and a transmission device having an inoperative condition in which it prevents displacement of the latch by the actuator and an operative condition in which it permits displacement of the latch by the actuator, the transmission device being linked to the key identification means and being displaced from its inoperative or rest condition into its operative or activated condition, in response to a signal received from the key identification means, the transmission device including a first member and a second member, the first and second members being longitudinally in register and longitudinally displaceable relative to the body, the first and second members also being longitudinally displaceable relative to one another between an extended position, towards which they are biased by a bias means, and a compressed position, the actuator including a lever arm which is mounted on the body for pivotal displacement about a pivot axis and which defines a cam, which cooperates with the first member such that displacement of the lever arm about the pivot axis causes the cam to abut against the first member and displace it longitudinally towards the second member, and retaining means which is displaceable in response to a signal received from the key identification means from a locked position, in which it inhibits longitudinal displacement of the second member, to a released position, in which it permits longitudinal displacement of the second member.

8. A lock as claimed in claim 7, in which the transmission device is positioned between the actuator and the latch.

9. A lock as claimed in claim 7, in which the transmission device, in its operative condition, forms an intermediate member which is displaceable by the actuator and which in turn displaces the latch to its unlocked position thereby permitting displacement of the bolt.

10. A lock as claimed in claim 7, in which the key identification means is a non-mechanical key identification means.

11. A lock as claimed in claim 7, in which the key identification means includes electronic control circuitry and communication means whereby the control circuitry can communicate with an encoded key to permit identification of the key by the control circuitry.

12. A lock as claimed in claim 11, in which the communication means is configured to permit wireless communication between the key and the control circuitry.

13. A lock as claimed in claim 11, in which the communication means includes at least one electrical contact which is connected to the electronic control circuitry and is mounted on the body for making contact with a complementary electrical contact on an electrically encoded key.

14. A lock as claimed in claim 7, in which the lever arm includes a bolt engaging formation configured to displace the bolt from its rest position to its displaced position.

15. A lock as claimed in claim 14, in which the bolt engaging formation and the cam are positioned on opposite sides of the pivot axis and configured such that the bolt engaging formation drivingly engages the bolt only after the cam has displaced the first member a sufficient distance such that when the retaining means is in its released position, the latch is displaced to its displaced position permitting displacement of the bolt.

16. A lock as claimed in claim 7, in which the first and second members are biased towards their extended position by means of at least one coil spring mounted in compression between them.

17. A lock as claimed in claim 7, in which the retaining means include at least one displaceable locking member which is displaceable between a rest position, in which it engages the second member to inhibit longitudinal displacement thereof, and displacement means for displacing the locking member from its rest position to a displaced position in which it permits displacement of the second member.

18. A lock as claimed in claim 17, in which the displacement means includes a solenoid.

19. A lock as claimed in claim 17, in which the retaining means includes a pair of locking members, each of which is displaceable from its rest position to its displaced position by means of a solenoid.

* * * * *